US007270469B2

(12) United States Patent
Goode et al.

(10) Patent No.: US 7,270,469 B2
(45) Date of Patent: Sep. 18, 2007

(54) APPARATUS AND METHOD FOR ADDING PIGMENTATION TO CONCRETE MIX

(75) Inventors: Leland Goode, Indianola, IA (US); Brian D. Lowe, Osceola, IA (US); Steven R. Merrill, Indianola, IA (US); John C. Eiland, Carrolton, TX (US)

(73) Assignee: Cemen-Tech, Inc., Indianola, IA (US)

( * ) Notice: Subject to any disclaimer, the term of this patent is extended or adjusted under 35 U.S.C. 154(b) by 444 days.

(21) Appl. No.: 10/864,585

(22) Filed: Jun. 9, 2004

(65) Prior Publication Data

US 2005/0276152 A1 Dec. 15, 2005

(51) Int. Cl.
*B28C 7/06* (2006.01)
*B28C 7/10* (2006.01)

(52) U.S. Cl. ..... 366/27; 366/38; 366/50; 366/153.2; 366/153.3; 366/155.2; 366/158.4; 366/319; 366/320

(58) Field of Classification Search .. 366/155.2–157.2, 366/20, 27–28, 35, 37–38, 49–50, 14–15, 366/158.4, 186, 320, 64–66, 297–300, 153.2, 366/153.3, 319
See application file for complete search history.

(56) References Cited

U.S. PATENT DOCUMENTS 1,786,556 A * 12/1930 Arnold et al. ..... 241/247
2,320,469 A * 6/1943 Rasmussen ..... 366/104
2,478,079 A * 8/1949 Beasley et al. ..... 366/156.1
2,509,543 A * 5/1950 Truax ..... 366/288
2,538,891 A * 1/1951 Zimmerman et al. .... 366/156.1
2,576,177 A * 11/1951 Herr ..... 366/299
2,991,870 A * 7/1961 Griffith et al. ..... 366/186
3,377,000 A * 4/1968 Mason, Jr. ..... 222/227
3,482,821 A * 12/1969 Blackwood ..... 366/186
3,570,569 A * 3/1971 Hartley et al. ..... 241/82.6
3,704,076 A * 11/1972 Bodunov et al. ..... 415/72
3,809,436 A * 5/1974 Ciaffone ..... 366/192
4,023,776 A * 5/1977 Greten ..... 366/153.2
4,023,779 A * 5/1977 Beloy ..... 366/20
4,117,547 A * 9/1978 Mathis et al. ..... 366/17
4,123,226 A * 10/1978 Vanderveen ..... 23/314
4,139,309 A * 2/1979 Billingsley ..... 366/186
4,148,100 A * 4/1979 Moller ..... 366/156.1
4,201,484 A * 5/1980 Sasiela et al. ..... 366/153.1
4,205,919 A * 6/1980 Attwell ..... 366/34
4,281,934 A * 8/1981 Krause et al. ..... 366/30

(Continued)

FOREIGN PATENT DOCUMENTS

DE 3629674 A1 * 3/1988

(Continued)

*Primary Examiner*—Charles E. Cooley
(74) *Attorney, Agent, or Firm*—McKee, Voorhees & Sease, P.L.C.

(57) ABSTRACT

A pigmentation dispenser utilizes a hopper having two rotors therein, a first rotor above a second rotor. The second rotor moves the pigmentation material through an outlet opening and deposits it on a conveyor containing a concrete mix. The concrete mix and pigmentation material are then moved to a mixer which mixes them together. A cleanout is also in communication with the hopper and the second rotor can be reversed to move the pigmentation toward the cleanout.

12 Claims, 2 Drawing Sheets

U.S. PATENT DOCUMENTS

| | | | | | |
|---|---|---|---|---|---|
| 4,298,288 | A | * | 11/1981 | Weisbrod | 366/8 |
| 4,322,168 | A | * | 3/1982 | Hartung et al. | 366/15 |
| 4,708,268 | A | * | 11/1987 | Wurtz | 222/238 |
| 4,712,919 | A | * | 12/1987 | Bouldin | 366/133 |
| 4,907,890 | A | | 3/1990 | Lepper | |
| 5,044,819 | A | * | 9/1991 | Kilheffer et al. | 404/72 |
| 5,333,762 | A | * | 8/1994 | Andrews | 222/238 |
| 5,358,331 | A | * | 10/1994 | Cruse | 366/160.3 |
| 5,401,402 | A | * | 3/1995 | Christy et al. | 210/205 |
| 5,433,968 | A | * | 7/1995 | Zarraga et al. | 426/574 |
| 5,494,351 | A | * | 2/1996 | Hakasalo | 366/318 |
| 5,524,796 | A | * | 6/1996 | Hyer | 222/241 |
| 5,570,953 | A | * | 11/1996 | DeWall | 366/10 |
| 5,590,976 | A | * | 1/1997 | Kilheffer et al. | 404/72 |
| 5,709,322 | A | * | 1/1998 | Ricciardi | 222/227 |
| 5,785,420 | A | * | 7/1998 | Schuff | 366/20 |
| 5,913,602 | A | * | 6/1999 | Steele | 366/132 |
| 6,030,112 | A | * | 2/2000 | Milek | 366/64 |
| 6,588,928 | B2 | * | 7/2003 | Huber et al. | 366/156.2 |
| 6,616,320 | B2 | * | 9/2003 | Huber et al. | 366/156.2 |
| 2002/0075754 | A1 | * | 6/2002 | Huber et al. | 366/152.1 |
| 2002/0075755 | A1 | * | 6/2002 | Huber et al. | 366/152.1 |
| 2002/0176319 | A1 | * | 11/2002 | Huber et al. | 366/186 |
| 2004/0136261 | A1 | * | 7/2004 | Huber et al. | 366/152.1 |
| 2005/0219939 | A1 | * | 10/2005 | Christenson et al. | 366/8 |
| 2005/0276152 | A1 | * | 12/2005 | Goode et al. | 366/6 |

FOREIGN PATENT DOCUMENTS

| | | | | |
|---|---|---|---|---|
| EP | 150353 | A1 | * | 8/1985 |
| JP | 55-127130 | | * | 10/1980 |
| JP | 3-120014 | | * | 5/1991 |

* cited by examiner

APPARATUS AND METHOD FOR ADDING PIGMENTATION TO CONCRETE MIX

BACKGROUND OF THE INVENTION

The present invention relates to an apparatus and method for adding pigmentation to concrete mix.

In the mixing of concrete, there are two basic approaches. The first is the batch process which causes the concrete to be mixed in batches. A typical example of the batch process is the use of cement trucks which carry batches of the concrete and which mix the concrete during transport.

The other method of processing concrete is the continuous method. In the continuous method, the concrete is continuously added to a conveyor which delivers the mixture of concrete and other materials to an auger mixer. The auger mixer then mixes the materials and discharges the mixed concrete continuously. A typical example of a continuous method is shown in U.S. Pat. No. 4,907,890.

In either the continuous method or the batch method it is desirable on occasion to add pigmentation to the concrete mixture before it is mixed. Pigmentation materials are very difficult to handle because they are often finely divided particles which compact and which are difficult to handle.

Therefore a primary object of the present invention is the provision of an improved apparatus and method for adding pigmentation to concrete mix.

A further object of the present invention is the provision of an apparatus and method for adding pigmentation to concrete mix wherein a hopper and two augers are provided for loosening and dispensing the pigmentation material.

A further object of the present invention is the provision of an improved apparatus and method for adding pigmentation to concrete mix wherein the augers or rotors include helical ribbon flighting having a central opening therein.

A further object of the present invention is the provision of an improved apparatus and method for adding pigmentation to concrete mix wherein the hopper or bin includes sloped edges which converge toward a bottom auger or rotor.

A further object of the present invention is the provision of an improved apparatus and method for adding pigmentation to concrete mix wherein a tube extends from the lower end of the hopper and an auger has a portion extending within the tube and a portion extending within the hopper.

A further object of the present invention is the provision of an improved apparatus and method for adding pigmentation to concrete mix which is efficient in operation and which is simple and easy to manufacture.

BRIEF SUMMARY OF THE INVENTION

The foregoing objects may be achieved by an apparatus for adding pigment to a concrete mixture. The apparatus comprises a hopper for containing pigmentation material to be added to the concrete mixture. The hopper has a lower end and an outlet opening adjacent the lower end for dispensing the pigmentation material from the hopper. A first rotor is mounted within the hopper above the outlet opening for rotation about a first horizontal axis. A second rotor is mounted within the hopper below the first rotor for rotation about a second horizontal axis. A drive system is connected to the first and second rotors for causing them to rotate about the first and second horizontal axis respectively. A cleanout is also provided in communication with the hopper. The second rotor is capable of moving pigmentation material to the outlet opening and causing the pigmentation material to be dispensed outwardly from the hopper through the outlet opening when rotated in a first direction. The second rotor when rotated in the opposite direction moves pigmentation material toward the cleanout.

A conveyor is located below the outlet opening of the hopper for receiving the pigmentation material dispensed from the outlet opening. The conveyor includes a concrete mixture thereon. The conveyor moves the concrete mixture below the outlet opening of the hopper so that the pigmentation material dispensed from the outlet opening is added to the concrete mixture. The conveyor has a discharge end adjacent a concrete mixer. The concrete mixer is adapted to receive the concrete mixture and the pigmentation material from the discharge end of the conveyor and to mix the concrete mixture and the pigmentation material together.

According to another feature of the present invention the first rotor includes a helical flighting thereon. The helical flighting may be in the shape of a helical ribbon, but other types of helical flighting may be used.

According to another feature of the present invention the first rotor includes radial beater bars for mixing the pigmentation material during the rotation of the first rotor. The second rotor may also comprise the helical flighting which may be in the shape of a helical ribbon or in some other helical shape.

As used herein, the term rotor refers to an elongated rotatable member. The rotor may have helical flighting thereon, radially extending beater bars, or a combination of the two. The helical flighting may be typical helical flighting or it may be ribbon helical flighting having an open center therein. A primary object of the rotors is to move and agitate the pigmentation material. Agitation is important in order to break up the finely ground particles of pigmentation and the movement is required in order to discharge the pigmentation from the hopper.

According to another feature of the present invention a mixing rod is attached to the helical flighting and is positioned off center from the longitudinal axis of the rotor. The mixing rod performs the function of holding the ribbon flighting together while at the same time providing a mixing function as it rotates about the longitudinal axis of the rotor.

According to another feature of the present invention an exit tube is positioned adjacent the outlet opening of the hopper. The lower most auger extends within the exit tube and also extends within the bottom of the pigmentation hopper. The rotor is exposed to the pigmentation material at the lower end of the pigmentation hopper, but protrudes within the tube and rotates within the tube adjacent the outlet opening.

The method of the present invention comprises placing the pigmentation within the hopper chamber. A first rotor is rotated to agitate and loosen the pigmentation material within the hopper chamber. A second rotor is rotated to cause the pigmentation material within the hopper to move toward and be dispensed outwardly through the outlet opening. The pigmentation material dispensed through the outlet opening is added to the concrete materials being conveyed below the outlet opening on a conveyor. The pigmentation material and the concrete material are deposited into a mixer and the mixer is used to mix the concrete materials and pigmentation materials together.

DETAILED DESCRIPTION OF THE PREFERRED EMBODIMENT

Figure 1:
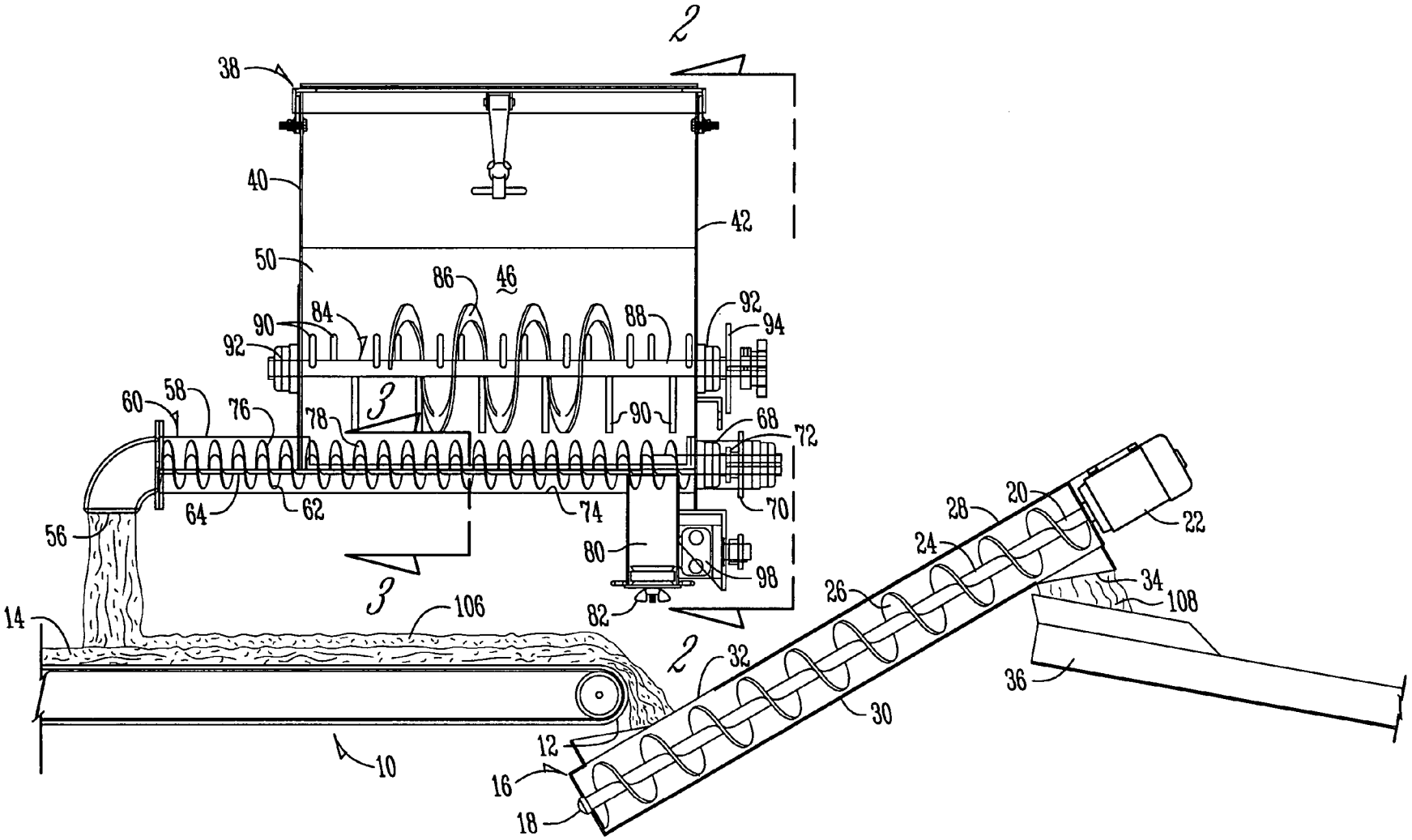
FIG. 1 is a sectional view of the present invention used in combination with a continuous concrete mixer.

Referring to the drawings, the numeral 10 designates a conveyor of a continuous concrete processor. Conveyor 10 has a discharge end 12 and carries a concrete mix 14 which has been deposited on the conveyor. Adjacent the discharge end 12 of the conveyor is an auger mixer 16 having a lowered end 18 and a raised or upper end 20. A motor 22 is attached to an auger shaft 24 which has helical auger fighting 26 thereon. A housing 28 surrounds the helical fighting and includes a rubber lower housing 30 and an inlet opening 32. A discharge opening 34 is provided adjacent the discharge end of the auger mixer 16 and a chute 36 is shown to carry the mixed concrete away.

Figure 2:
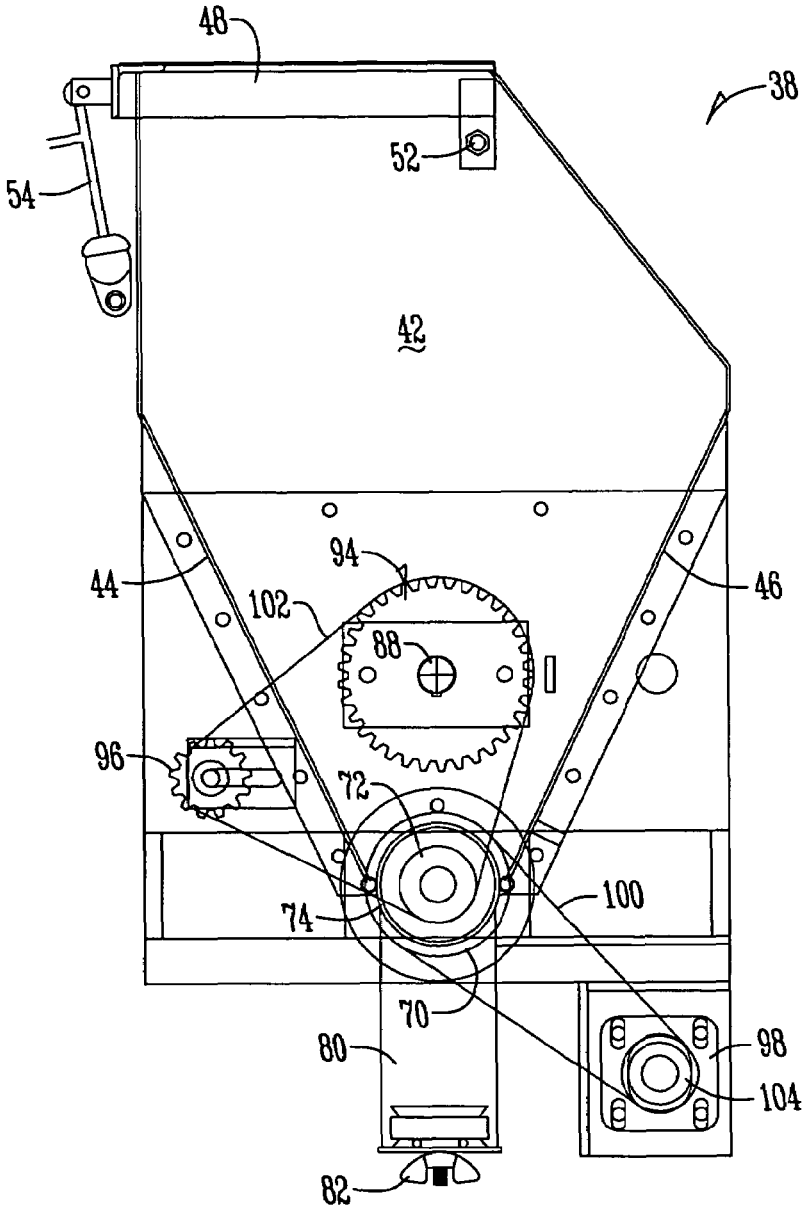
FIG. 2 is a sectional view taken along line 2-2 of FIG. 1.

A pigmentation housing 38 is in the form of a hopper having opposite end walls 40, 42, a V-shaped front wall 44 (FIG. 2) and a V-shaped back wall 46. As can be seen in FIG. 2, the V-shaped front and rear walls 44, 46 converge toward one another and meet at a rounded bottom 74. A lid 48 is provided at the top of the hopper 30. Within the hopper 30 is a hopper chamber 50. The lid 48 includes a lid handle 54 and is pivotal about an axis provided by lid pivot 52. The handle 54 can be used to raise the lid to insert pigmentation into the hopper chamber 50.

The lower end of the hopper 38 includes an outlet opening 56 which provides communication into the interior of hopper chamber 50 through a rotor tube 58.

Figure 3:
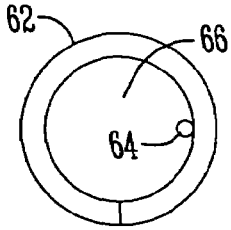
FIG. 3 is a sectional view taken along line 3-3 of FIG. 1.

A bottom rotor 60 includes an elongated helical ribbon 62. The helical ribbon forms an open center (FIG. 3) 66. An elongated rod 64 is welded or otherwise attached to the interior edge of the helical ribbon 62. Rod 64 is located off center with respect to the rotational axis of the rotor 60 so that rotation of the rotor 60 causes the rod 64 to move in a circular path around the rotational axis and thereby agitate and loosen the pigmentation material within the housing chamber 50. The bottom rotor 60 is rotatably mounted to end wall 42 by means of a bearing 68. The opposite end of the rotor 60 is fitted within the rotor tube 58 to create an enclosed portion 76 of the rotor. The remainder of the rotor is designated by the numeral 78 and is in communication with the hopper chamber 50. The ribbon section 78 of rotor 60 is exposed to the pigmentation and is not encased in any kind of tube. At the outer end of the rotor 60 is a large sprocket 70 and in addition, a small sprocket 72 is provided on this outer end outside the hopper 38.

A clean out 80 is best seen in FIG. 2. Clean out 80 is in communication with the interior of the hopper chamber 50 and is located at the lower most end and the rounded bottom portion 74 of the hopper 38. A clean out plug 82 is removably inserted in the clean out 80 to normally prevent pigmentation from exiting through the clean out 80.

An upper rotor 84 includes a helical ribbon 86 which is attached to an elongated rotor shaft 88. Also extending outwardly from the rotor shaft 88 are a plurality of radial beater bars 90. The opposite ends of shaft 88 are mounted in the two opposite bearings 92. A large sprocket 94 is mounted outside the hopper 38 and an idler sprocket 96 (FIG. 2) is also mounted for rotation outside the hopper 38.

A motor 98 is mounted to the rear under surface of the hopper 38 and includes a first drive chain 100 which is trained around a sprocket 104 on the motor 98 and is also trained around the large sprocket 70 on the end of lower rotor 60. A second drive chain 102 is trained around the small sprocket 72 on the lower rotor 60 and is also trained around idler sprocket 96 and the large sprocket 94 on the upper rotor 84.

In operation, the motor 98 is driven in a first rotational direction and causes rotation of the upper rotor 84 and the lower rotor 60. Upper rotor 84 agitates the pigmentation and moves the pigmentation materials to the right as viewed in FIG. 1. Similarly, the beater bars 90 further agitate and loosen the pigmentation material. The lower rotor 60 moves the pigmentation material to the left as viewed in FIG. 1. The ribbon flighting 62 of the lower rotor 60 facilitates this moving action. At the same time, the rod 64 further agitates and loosens the material. The pigmentation material is moved outwardly and dispensed from the outlet opening 56 through tube 58. It has been found that ribbon flighting on both the upper rotor 84 and the lower rotor 60 works best with the present invention. Other types of flighting may be used, but this has been found to be the most advantageous for loosening and moving the pigmentation material.

The pigmentation material is then deposited on the conveyor and is designated by the numeral 106. It is deposited on the concrete mix 14. At the discharge end of the conveyor 10 the combination of the pigmentation material 106 and the other concrete materials 14 are deposited into the inlet opening 32 of the auger mixer 16. The rotation of the auger mixer 16 causes the pigmentation and the other concrete materials to be mixed and ultimately discharged from dispensing opening 34. Water may be added to the inlet opening 32 to create the desired concrete mix. The resulting mixture is designated by the numeral 108, and includes the pigmentation material dispersed throughout the concrete mixture. The result is the pouring of concrete having the color provided by the pigmentation material 106.

When it is desired to clean out hopper 38, the motor 98 is reversed and the plug 82 is removed from the clean out 80. Reversal of motor 98 causes the lower rotor 60 to move the pigmentation material to the right as viewed in FIG. 1 so that it drops out through clean out 80.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstance may suggest or render expedient without departing from the spirit or scope of the invention as further defined in the following claims.

What is claimed is:

1. Apparatus for adding pigmentation material to a concrete mixture, comprising:

a hopper for containing the pigmentation material and having a bottom wall;

a lower horizontal rotor with flighting positioned adjacent the bottom wall of the hopper and having opposite first and second ends;

an upper horizontal rotor with flighting positioned in the hopper above the lower rotor;

an outlet opening adjacent the first end of the lower rotor;

a cleanout opening adjacent the second end of the lower rotor, the cleanout opening being normally closed to prevent pigmentation material from exiting through the cleanout opening;

a drive system to rotate the upper and lower rotors;

the drive system being adapted to rotate the lower rotor in opposite first and second directions for moving the pigmentation material towards the outlet and cleanout openings, respectively;

a conveyor below the outlet opening for carrying the concrete mixture and receiving the pigmentation material discharged through the outlet opening;

the conveyor having a discharge end;

a concrete mixer adjacent the discharge end of the conveyor for receiving the concrete mixture and pigmentation material from the conveyor and for mixing the concrete mixture and pigmentation material together.

2. The apparatus of claim 1 wherein the upper rotor flighting is in the shape of a helical ribbon having an open center along the longitudinal axis thereof.

3. The apparatus of claim 2 wherein the upper rotor includes radial beater bars for mixing the pigmentation material during the rotation of the upper rotor.

4. The apparatus of claim 1 wherein the lower rotor flighting is in the shape of a helical ribbon having an open center along the longitudinal axis thereof.

5. The apparatus of claim 4 wherein an elongated mixing rod is within the open center and is attached to the lower rotor flighting.

6. The apparatus of claim 5 wherein the mixing rod is positioned off center from the longitudinal axis of the lower rotor.

7. The apparatus of claim 1 wherein the outlet opening includes an exit tube, the lower rotor extending within the exit tube.

8. The apparatus of claim 7 wherein the hopper includes a hopper chamber and the exit tube extends outwardly beyond the hopper chamber, the lower rotor having one portion extending within the exit tube and having a second portion within the hopper chamber and being exposed directly to the pigmentation material within the hopper chamber.

9. The apparatus of claim 1 wherein the upper rotor has a diameter larger than the lower rotor.

10. The apparatus of claim 1 wherein the upper rotor and the lower rotor both include helical ribbon flighting that has an elongated open center.

11. The apparatus of claim 10 wherein the lower rotor includes a longitudinal axis and an elongated rod is attached to the helical ribbon flighting off-center from the longitudinal axis.

12. The apparatus of claim 1 further comprising a plug removably mounted in the cleanout opening for normally closing the cleanout opening.

* * * * *